US006728507B2

(12) United States Patent
Yamamoto et al.

(10) Patent No.: US 6,728,507 B2
(45) Date of Patent: Apr. 27, 2004

(54) ELECTROSTATIC IMAGE FORMING APPARATUS WITH FLUORORESIN IN FIXING ROLLER LAYER

(75) Inventors: Naoyuki Yamamoto, Ibaraki (JP); Makoto Jinzai, Chiba (JP); Masayoshi Kachi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/944,138

(22) Filed: Sep. 4, 2001

(65) Prior Publication Data

US 2002/0028099 A1 Mar. 7, 2002

(30) Foreign Application Priority Data

Sep. 4, 2000 (JP) ..... 2000/267534
Sep. 12, 2000 (JP) ..... 2000/276791

(51) Int. Cl.[7] ..... G03G 15/20
(52) U.S. Cl. ..... 399/333; 399/325; 430/105
(58) Field of Search ..... 399/333, 324, 399/325, 267, 277, 282; 430/105, 45

(56) References Cited

U.S. PATENT DOCUMENTS 5,639,549 A * 6/1997 Fukunaga et al.
5,672,452 A * 9/1997 Kanbayashi et al.
5,698,354 A * 12/1997 Ugai et al.
5,987,293 A * 11/1999 Diels ..... 399/325
6,077,636 A * 6/2000 Moriki et al.
6,104,892 A * 8/2000 Kobayashi et al.
6,131,010 A * 10/2000 Kume et al. ..... 399/333
6,389,245 B2 * 5/2002 Shida et al.

FOREIGN PATENT DOCUMENTS

JP 2001-66936 * 3/2001

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus forms an electrostatic latent image corresponding to an image information signal on an image carrying member, develops the electrostatic latent image using a two component developer of toner particles and carrier particles and transfers the unfixed image to a transfer medium. A fixer is provided with at least a fixing roller and a press roller which nips and delivers the transfer medium to fix the unfixed image. The carrier particles contain a binder resin and magnetic metal oxide and have shape factors SF-1 of 100 to 150 and SF-2 of 100 to 150. The fixing roller has an elastic layer and a release layer of a fluorine resin having an Asker-C hardness between 60° and 85° at the time of application of a 1 kg load.

5 Claims, 5 Drawing Sheets

ELECTROSTATIC IMAGE FORMING APPARATUS WITH FLUORORESIN IN FIXING ROLLER LAYER

BACKGROUND OF THE INVENTION

1. Field of the Invention

The present invention relates to an image forming apparatus for forming a visible image by developing an electrostatic latent image formed on an image carrying member by electrophotography, electrostatic recording or the like, such as a copying machine, printer, recorded image display device or facsimile or the like.

2. Related Background Art

By a well known method according to the prior art, a dry developer is carried on the surface of a developer carrying member, this developer is carried and supplied to the vicinity of an image carrying member carrying an electrostatic latent image, and the electrostatic latent image is developed into a visible image while an alternating electric field is applied between the image carrying member and the developer carrying member. As a developing sleeve is frequently used in general as the developer carrying member, the developer carrying member will be referred to as the "developing sleeve" in the following description and, as a photosensitive drum is often used in general as the image carrying member, the image carrying member will be represented by the "photosensitive drum" hereinafter.

The developing process according to the prior art, particularly in a color image forming apparatus, uses a developer consisting of two different components (carrier particles and toner particles) (two component developer) for better expression of color tints. A magnetic brush is formed on the surface of a developing sleeve with a magnet arranged inside; this magnetic brush is brought into sliding contact with or close to the photosensitive drum positioned opposite the developing sleeve with a slight developing gap in-between; and an alternating electric field is continuously applied between the developing sleeve and the photosensitive drum. This results in development by repeated shifts of toner particles back and forth between the developing sleeve and the photosensitive drum. It is known as a magnetic brush developing process.

A developing unit for this two component magnetic brush developing process has a main constitution as illustrated in FIG. 1. Referring to FIG. 1, reference numeral 21 denotes a developing sleeve; 23, a magnet roller fixed within the developing sleeve; 24 and 25, stirring screws; 18, a regulating blade arranged for forming a developer in a thin layer over the surface of the developing sleeve 21; 27, a developing vessel; and 28, a toner storage. The developing sleeve 21 is arranged close to the photosensitive drum 1 and, as illustrated in the figure, rotates in a reverse direction to the photosensitive drum 1 and so set that development can be accomplished in a state in which the developer is in contact with the photosensitive drum 1.

The two component developer is accommodated in the developing vessel 27 as a developer 19 in which toner particles and carrier particles are mixed, and the proportion of the weight of the toner particles to the combined weight of the toner particles and the carrier particles is kept constant by the dropping supply of toner in a volume matching the volume of toner consumed by the development from the toner storage 28 in which toner for replenishment is accommodated.

On the other hand, in a fixing device to be fitted to an image forming apparatus such as a copying machine or printer or the like, usually as a fixing rotator a fixing roller with a built-in heater and a press roller as a press rotator are brought into contact with each other to constitute a fixing nip, and a recording medium (transfer medium) carrying an unfixed toner image is passed through this fixing nip to have the unfixed toner image fixed on the recording medium as a permanent image by heat and pressure.

Whereas image formation using a two component developer well suited to the formation of a full color image can be accomplished with an apparatus constituted as described above, full color image forming apparatuses are now required to be further reduced in size and cost.

As a full color image forming apparatus usually requires sufficient melting and color-mixing of the toner, a soft roller made of an elastic material such as silicone rubber or fluoro-rubber or the like is often used. Also, from the viewpoints of fixing performance, image quality and toner releasing property or the like, rubber of relatively low hardness is used for the release layers of the fixing roller and the press roller, and the surfaces of these layers are further coated with a release agent such as silicone oil.

However, the above-described means involves not only the problem of requiring a complex and large fixing device but also the disadvantage of reducing the durability of the fixing roller and correspondingly increasing the cost because the coating with oil invites stripping of the elastic layer constituting the fixing roller.

To solve these problems, fluorine resin such as tetrafluoroethylene perfluoroalkylvinyl ether (PFA) or polytetrafluoroethylene (PTFE), which can be expected to be able by itself to release the toner, may be used for the release layer of the fixing roller.

This constitution according to the prior art, however, involves the following problems.

Fluorine resin, typical examples of which are cited above, is usually hard and inflexible, and is unable, especially in fixing a full color image, to follow the surface unevenness of the unfixed toner image, often destroying the toner image. This could lead to deteriorated reproducibility of dots or luster unevenness in areas of fine area. On account of this problem, an elastic layer consisting of fluoro-rubber or silicone rubber is often provided between the core metal and the release layer where the release layer of the fixing roller is made of fluorine resin.

Moreover, fluorine resin, typically PFA, has a general material disadvantage of being less resistant to abrasion and mechanical damage. On the other hand, stirring within the developing unit causes friction between the toner and the carriers or between the carriers to scrape off the unevenness of the carrier surface. Fine powder of the carriers resulting from this scraping, together with the toner, forms an unfixed image, which sticks to the surface of the fixing roller.

As a result, the fine powder stuck to the fixing roller finds its way between the components of the cleaning mechanism including a cleaning roller and a cleaning pad, sticks to the surface of the fixing roller, accumulates on a thermistor for sensing the surface temperature of the fixing roller, and damages the release layer of the fixing roller. This may invite a flaw in the contact (powder accumulating) part of the thermistor or a defect in the image known as an offset. Especially where the fixing roller consists of an elastic layer and fluorine resin, as the thermistor part cuts into the fixing roller, accumulation of the fine powder on the thermistor may accelerate damaging of the fluorine resin.

The present invention is achieved to provide a compact and low cost image forming apparatus and image forming method capable of restraining the occurrence of flaws and image defects, including offsets, even where PFA or some other fluorine resin is used for the release layers of the fixing roller and the press roller.

SUMMARY OF THE INVENTION

In order to resolve the above described problems, according to the invention, there is provided an image forming apparatus having image forming means for forming an electrostatic latent image corresponding to an image information signal on an image carrying member, forming an unfixed image by developing the electrostatic latent image using a two component developer consisting of toner particles and carrier particles and transferring the unfixed image to a transfer medium; and fixing means, provided with at least a fixing roller and a press roller, for nipping and deliverying the transfer medium with these rollers to fix the unfixed image, wherein the carrier particles contain at least binder resin and magnetic metal oxide and have shape factors SF-1 of 100 to 150 and SF-2 of 100 to 150, and the fixing roller has an elastic layer and a release layer consisting of fluorine resin, with its Asker-C hardness ranging between 60° and 85° at the time of application of a load of 1 kg.

According to the invention, there is also provided an image forming apparatus having image forming means for forming an electrostatic latent image corresponding to an image information signal on an image carrying member, forming an unfixed image by developing the electrostatic latent image using a two component developer consisting of toner particles and carrier particles and transferring the unfixed image to a transfer medium; and fixing means for nipping and deliverying the transfer medium with a fixing roller and a press roller to fix the unfixed image, wherein the carrier particles are a magnetic resin carrier containing binder resin, magnetic metal oxide and non-magnetic metal oxide produced by polymerization and the surface layer material of at least either the fixing roller or the press roller contains silicone rubber or fluoro-rubber.

DETAILED DESCRIPTION OF THE PREFERRED EMBODIMENTS

Preferred Embodiments

Embodiment 1

Figure 1:
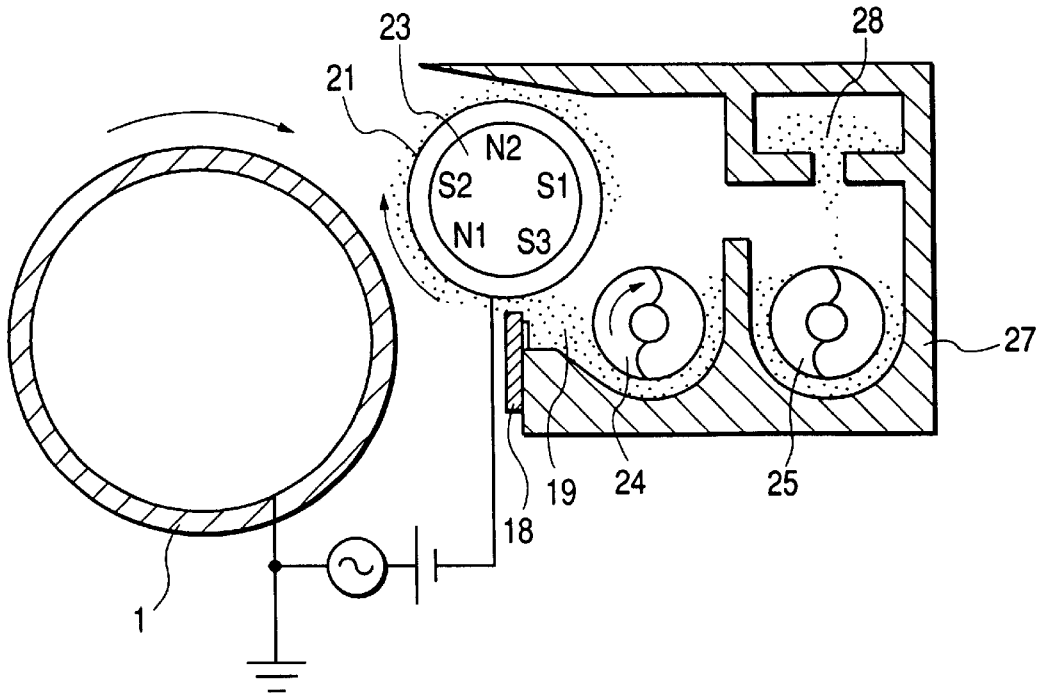
FIG. 1 PRIOR ART
FIG. 1 shows a schematic cross section of a conventional developing unit for two component magnetic brush development.

The present invention is characterized by the use, in an image forming process using a two component developer, of fixing means having carrier particles containing at least binder resin and magnetic metal oxide and having shape factors SF-1 of 100 to 150 and SF-2 of 100 to 150, an elastic layer and a release layer consisting of fluorine resin and provided with a fixing roller whose Asker-C hardness ranges between 60° and 85° at the time of application of a load of 1 kg. The image forming apparatus and image forming method according to the invention is limited by no other features than the above-noted characteristics, but can utilize many different known techniques.

The image forming means may be any means as far as it can at least electrically charge a photosensitive drum, form a latent image, and develop and transfer the image in an electrophotographic image forming process, and can be constituted of various known apparatuses and/or members including a photosensitive drum, charging device, exposing device, developing device and transfer device or the like. The image forming means may further have some other device, such as a cleaning device for removing a toner remaining on the photosensitive drum after the image transfer.

The fixing means should have at least a fixing roller and a press roller, and fixes an unfixed image by nipping a transfer medium between them and deliverying it. The fixing means may be any means as far as it is provided with a fixing roller and a press roller having the above-stated characteristics, and may further has cleaning means (e.g. a cleaning roller and a cleaning pad) for removing foreign matter on the surface of the fixing roller. Nor is there any particular limitation to the heating device for melt-depositing the toner to fix the unfixed image on the transfer medium in the fixing means, but a known heating device can be used.

The fixing roller is characterized in that it has an elastic layer and a release layer consisting of fluorine resin and that its Asker-C hardness ranges between 60° and 85° at the time of application of a load of 1 kg. This fixing roller, while its face in contact with a transfer medium rotates, melts toner particles forming an unfixed image on the transfer medium. The press roller, while its face in contact with the transfer medium rotates, presses the transfer medium moderately toward the fixing roller. As these fixing roller and press roller, heating and pressing type fixing roller can be suitably used.

A fixing roller with an Asker-C hardness of less than 60° under a load of 1 kg may involve extremely poor durability of the elastic layer itself, or where the hardness is above 85° the elastic layer cannot be expected to prove effective. It would be unable to follow the surface unevenness of the unfixed toner image when fixing a full color image and spoil the toner image, lead to deteriorated reproducibility of dots or luster unevenness in areas of fine area.

The Asker-C hardness of the fixing roller is measured with an Asker-C rubber hardness tester available from Kobunshi Keiki Co., Ltd. In more detail, a load of 1 kg is applied to the fixing roller, the rubber hardness counts of the fixing roller at five random points under this load are measured with this tester, and the average of the five counts is used as the Asker-C hardness of the fixing roller. The Asker-C hardness of the fixing roller can be adjusted according to the material and thickness of the elastic layer.

The release layer, intended for smoothly releasing the transfer medium on which the image is fixed from the fixing roller and the press roller, is characterized by its being made of fluorine resin according to the invention. While the release layer is provided on the surface of the fixing roller, another release layer can be further provided on the surface of the press roller.

Fluorine resin is a suitable material in terms of releasing property. There is no limitation to the applicable type of fluorine resin as long as it can endure the conditions of toner melt-deposition including that of heating, and suitable fluorine resins include tetrafluoroethylene perfluoroalkylvinyl ether (PFA), polytetrafluoroethylene (PTFE) and tetrafluoroethylene hexafluoropropylene copolymer (FEP), for example.

The above described elastic layer, intended to compensate for weaknesses of fluorine resin by enabling the release layer to follow the surface unevenness due to the unfixed toner image and the unfixed toner image to be fixed with high reproducibility, and can be suitably constituted of an elastic member made of fluoro-rubber or silicone rubber or the like.

The fixing roller temperature sensing means, being a contact type device, is useful for precision control of the fixing conditions and preferable for use in the present invention. As the invention uses carrier particles of a type to be described in further detail afterwards, the generation of finely pulverized pieces (fine powder) of the carrier particles can be restrained, sticking of the fine powder to the fixing roller can be restrained even though a release layer of the aforementioned kind of fluorine resin is used, making it difficult for the fixing roller temperature sensing means to be broken or caused to detect wrongly by the accumulation of the fine powder. Therefore, contact type temperature sensing means, which senses the temperature in contact with the fixing roller can be used suitably. As such temperature sensing means, various known temperature sensing means (including the aforementioned thermistor) are available for use.

The two component developer contains toner particles and carrier particles. The two component developer may further contain some other powder material or materials for adjusting the electrical chargeability of toner particles and the fluidity of the developer in addition to the toner particles and the carrier particles.

The toner particles may be any toner particles as long as they are usable in a two component developer. Preferably, they should be non-magnetic toner particles, which can be constituted by a conventional method by using proper quantities of binder resin such as styrene resin or polyethylene resin, a coloring agent which may be carbon black, dye or pigment, a release agent such as wax, and a charge control agent. The particle size of the toner particles should preferably be about 5 to 10 $\mu$m for obtaining an image of high quality.

The carrier particles are characterized in that they contain at least binder resin and magnetic metal oxide, and that their shape factors SF-1 and SF-2 both range from 100 to 150. Any carrier particles having these characteristics and capable of carrying and deliverying the toner particles can be used. The particle size of the carrier particles should preferably be about 15 to 60 $\mu$m for satisfactorily carrying and deliverying the toner particles.

The shape factors indicate the shape and surface state of the carrier particles. In more detail, the shape factor SF-1 represents the relative sphericity of the carrier particles. The closer this factor to 100, the closer the shape to exact sphericity, and the greater this factor, the more indeterminate the shape. The factor SF-2 represents the surface unevenness of the carrier particles. The closer this factor to 100, the flatter the surface, and the greater the factor, the more conspicuous the unevenness.

For the present invention, an electron microscope FE-SEM (S-800) manufactured by Hitachi, Ltd. was used to take 100 random samples of carrier particles in the developer, and their image information was via an interface inputted to an image analyzer (Luzex 3) manufactured by Nicolet Company to perform analysis. The values obtained by the following equations were defined to be the shape factors SF-1 and SF-2 , respectively.

$$SF\text{-}1=(MXLNG)^2/AREA\times(\pi/4)\times100$$

$$SF\text{-}2=(PERI)^2/AREA\times(1/4\pi)\times100$$

In the equations, AREA is the projected area of the carrier particle; MXLNG, the absolute maximum length of the carrier particles; and PERI, the circumferential length of the carrier particles.

If the SF-1 and SF-2 are greater than 150, the carrier particles become less determinate and more susceptible to deformation by abrasion and to generation of fine powder by abrasion.

In contrast to the shape factors of the spherical carrier particles, the shape factors SF-1 and SF-2 of conventional carrier particles are respectively 180 to 220 and 180 to 200, revealing the greater closeness of the carrier particles used in the present invention to the exact sphere than the conventional carrier particles. The carrier particles used in the present invention are less susceptible to shape factor variations of carrier particles due to developer deterioration than the conventional carrier particles. For instance, to look at shape factor variations accompanying the stirring and compression of the developer when the developing device has operated for five hours, the shape factors SF-1 and SF-2 of the carrier particles according to the present invention are almost unchanged at 100 to 135 and 100 to 140, respectively, those of the conventional carrier particles are 120 to 150 of SF-1 and 100 to 140 of SF-2 , respectively, closer to the exact sphere than at the beginning of operation. This finding indicates that, while the conventional carrier particles are subjected by stirring to friction between the toner particles and the carrier particles or between the carrier particles themselves to scrape off the unevenness of the carrier surface and accordingly are more subject to shape variations toward the exact sphere, the carrier particles used in the present invention are close to the exact sphere from the outset and involve less of factors subject to shape variations than the conventional carrier and accordingly undergo less of shape variations.

The binder resin may consist of one or more of various kinds of known resin compounds according to the desired characteristics of the carrier particles including fluidity, abrasion-resistance, thermal resistance and electrical chargeability. A number of examples of applicable binder resin can be cited, including styrene resin, polyester resin, fluorine resin, acrylic resin and silicon resin. The binder resin may be obtained either by melting a resin compound or polymerizing polymeric monomers which constitute a resin when polymerized.

As the magnetic metal oxide, one or more of various kinds of known magnetic metal oxide can be used according to the desired physical properties of the carrier particles including magnetic force and electrical resistance. Metal oxides include ferrite powder of copper, nickel, zinc, cobalt, manganese or magnesium. A more preferable example is magnetite ($Fe_3O_4$).

The carrier particles according to the present invention may contain, in addition to magnetic metal oxide, non-magnetic metal oxide. As the non-magnetic metal oxide, one or more of various kinds of known non-magnetic metal oxide can be used according to the desired characteristics of the carrier particles including fluidity and electrical chargeability. Examples of applicable non-magnetic metal oxide include silica and alumina.

The carrier particles can be prepared by any methods as long as the product has the above-described constitution and satisfies the above-stated shape factor requirement. For instance, the carrier particles may be produced by the so-called pulverization method, i.e. by melting the binder resin, kneading the molten binder resin with other materials, solidifying the binder resin by cooling, pulverizing it, shaping it by thermal treatment or otherwise and classifying the shaped product, but polymerization is more preferable.

The polymerization is a manufacturing method by which polymeric monomers constituting the binder resin are mixed with other materials to obtain a monomer system, this monomer system is put into an aqueous medium containing a dispersion stabilizer and stirred to form liquid droplets, and polymerization is carried out in this state with a polymerization initiators or the like to produce carrier particles (so-called suspension polymerization). This can be used as a suitable production method for the carrier particles for use in the present invention. The above-described polymerization method may be replaced by an emulsion polymerization method in which an emulsifier is used in place of the dispersion stabilizer.

Polymeric monomers usable in the above-described polymerization process include monomers and cross linking agents that can be polymerized into the above-described binder resin. Examples of the monomers for preferable use include styrene compounds, acrylates and methacrylates. Examples of the cross linking agents for preferable use include divinyl compounds, such as divinyl benzene, and carboxylic esters having two or more double bonds, such as ethylene glycol. The usable polymeric monomers are not limited to the examples cited above, but various other polymeric compounds can be used. Also, besides the polymeric monomers, other resin compounds may be added to the monomer system.

It is desirable for the polymerization initiator to be appropriately selected according to the types of monomers and the desired characteristics of the carrier particles to be produced. Preferable examples include diazo-based polymerization initiators such as 2,2'-azobis-(2,4-dimethyl valeronitrile) and 2,2'-azobis isobutylonitrile and peroxidic polymerization initiators such as benzoyl peroxide and the like.

As the dispersion stabilizer for use in this polymerization process, various known organic and inorganic dispersants are available. It is preferable to use an inorganic dispersant as the dispersion stabilizer in respect of temperature stability and washing ease, and such inorganic dispersants include phosphatized polyvalent metal such as calcium phosphate.

Surface-active agents usable in this polymerization process include many known kinds, of which some of the more preferable examples are sodium dodecylbenzenesulfate and sodium tetradecylsulfate. A dispersion stabilizer and a surface-active agent may be used in combination as required.

The image forming apparatus and the image forming method according to the present invention, as they use the above-described release layer and carrier particles, can ensure sufficient melting of the toner at the time of image fixing by virtue of the highly flexible release layer and, at the image forming step, restrain the generation of fine powder due to the abrasion of the carrier particles. Therefore, the image forming apparatus and the image forming method according to the present invention can be used in a desirable way in a full color image forming apparatus and an image forming method, respectively, for the formation of full color images.

Figure 2:
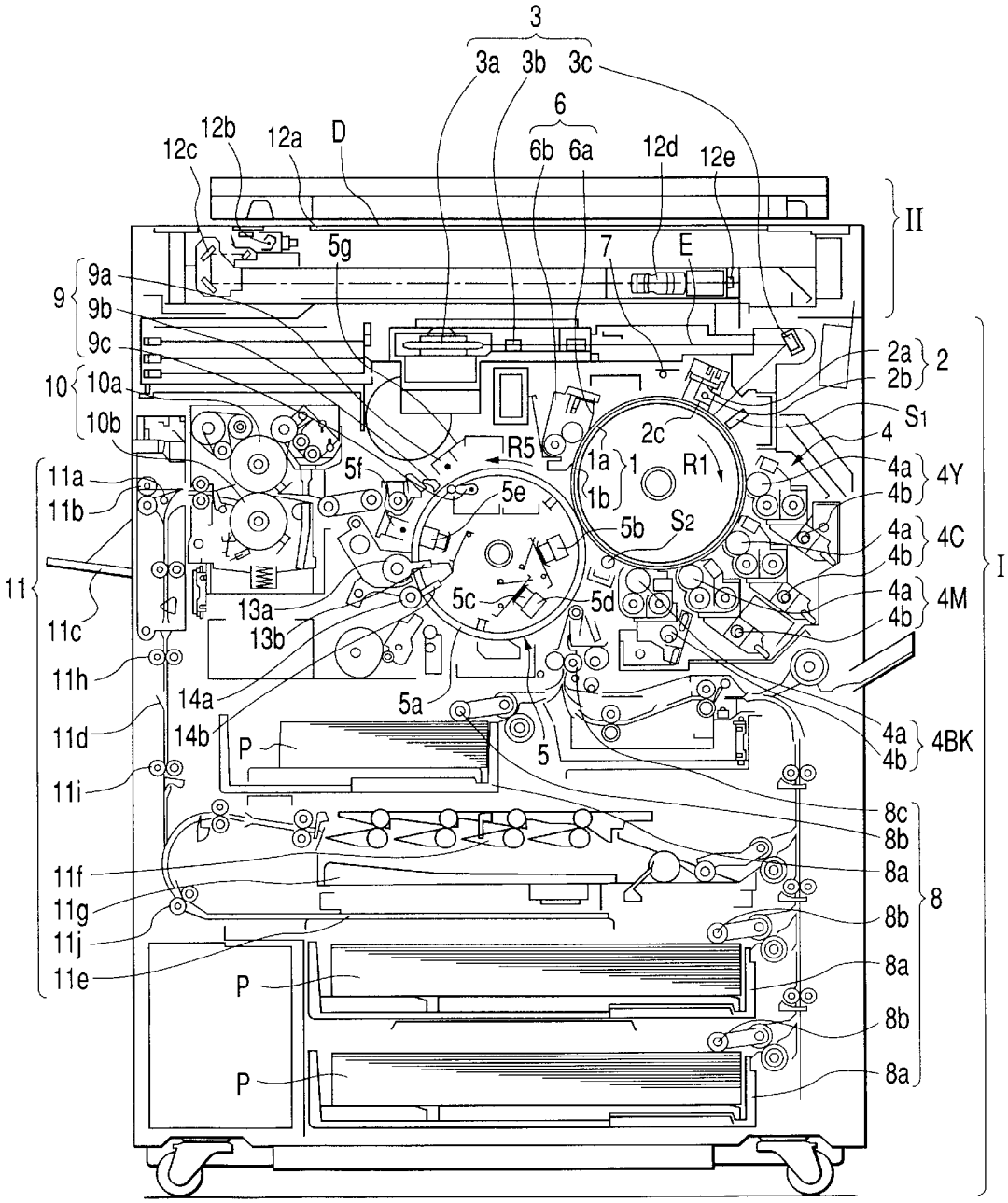
FIG. 2 shows a cross section of an example of an image forming apparatus according to the present invention.

FIG. 2 schematically illustrates the constitution of a digital full four-color image forming apparatus as an example of image forming apparatus according to the present invention.

The image forming apparatus illustrated therein, provided with a digital color image printer unit (hereinafter to be referred to as merely "the printer unit") I in the lower part and a digital color image reader unit (hereinafter to be referred to as merely "the reader unit") II in the upper part, forms an image on a recording medium P, which is a transfer medium, with the printer unit I on the basis of, for instance, a subject copy D picked up by the reader unit II.

The constitution of the printer unit I, and then that of the reader unit II, will be briefly described below.

The printer unit I has a photosensitive drum 1, rotationally driven in the R1 direction, as an image carrying member. Around the photosensitive drum 1 are arranged a primary charger (charging means) 2, exposing means 3, a developing unit (developing means) 4, a transferring unit 5, a cleaner 6, a pre-exposing lamp 7 and so forth in that order in the rotating direction of the photosensitive drum. Underneath the transferring unit 5, i.e. in the lower half of the printer unit I, there is arranged a paper feeder 8 of the recording medium P, and above the transferring unit 5 is arranged separating means 9. Downstream from the separating means 9 (downstream in the deliverying direction of the recording medium P) are arranged a fixing device (fixing means) 10 and a paper output unit 11.

The photosensitive drum 1 has an aluminum-built drum-shaped body 1*a* and a photosensitive material 1*b* of organic photo-semiconductor (OPC) covering the backside of the body, and is constituted to be driven by drive means (not shown) in the direction of arrow R1 at a prescribed process speed (peripheral speed). The photosensitive drum 1 will be described in further detail afterwards.

The primary charger 2 is a corona charger having a shield 2*a* whose part opposite the photosensitive drum 1 is open, a discharging wire 2*b* arranged within the shield 2*a* in parallel to the bus of the photosensitive drum 1, and a grid 2*c* arranged in the opening of the shield 2*a* for regulating the charge potential. To the primary charger 2 is applied a charge bias from a power source (not shown) to uniformly charge the surface of the photosensitive drum 1 in a prescribed polarity and at a prescribed potential.

The exposing means 3 has a laser output section (not shown) for emitting a laser beam on the basis of an image signal from the reader unit II to be described later, a polygon mirror 3*a* for reflecting the laser beam, a lens 3*b* and a mirror 3*c*. The exposing means 3 is so constituted that the photosensitive drum 1 be exposed to light by the irradiation of the surface of the photosensitive drum 1 with the laser beam and an electrostatic latent image be formed by the removal of the electric charge on the irradiated portion. In this embodiment, the electrostatic latent image formed on the surface of the photosensitive drum 1 is separated on the basis of the image on the subject copy into yellow, cyan, magenta and black images, of which electrostatic latent images are formed in succession.

The developing unit 4 has four developing devices in succession from upstream downward along the rotating direction of the photosensitive drum 1 (the direction of arrow R1), i.e. developing devices 4Y, 4C, 4M and 4Bk containing toners (developers) in the respective colors including yellow, cyan, magenta and black, each based on a corresponding resin. Each of the developing devices 4Y, 4C, 4M and 4Bk has a developing sleeve 4*a* for sticking the corresponding toner to the corresponding electrostatic latent image formed on the surface of the photosensitive drum 1, and the developing device of the prescribed color to be used in the development of the electrostatic latent image is arranged by an eccentric cam 4*b* alternatively in a developing position close to the surface of the photosensitive drum 1. The toner is stuck to the electrostatic latent image via the developing sleeve 4*a* to form a toner image (visible image) as a manifest image. The developing devices for the three other colors than the developing device currently used for development are kept away from the developing position.

The transferring unit 5 has a transfer drum (recording medium carrying member) 5*a* for carrying the recording medium P on the surface, a transfer charger 5*b* for transferring the toner image on the photosensitive drum 1 to the recording medium P, an attracting charger 5*c* for attracting the recording medium P to the transfer drum 5*a*, an attracting charger 5*d* opposite thereto, an internal charger 5*e* and an external charger 5*f*. A recording medium carrying sheet 5*g* consisting of a dielectric integrally spans in a cylindrical shape the peripheral opening of the transfer drum 5*a* borne to be rotationally driven in the direction of arrow R5. As the recording medium carrying sheet 5*g*, a dielectric sheet of polycarbonate film or the like is used. The transferring unit 5 is so constituted as to attract the recording medium P to the surface of the transfer drum 5*a* and to carry it in the attracted state.

The cleaner 6 is provided with a cleaning blade 6*a* for scraping off the residual toner remaining on the surface of the photosensitive drum 1 without being transferred to the recording medium P and a scraped toner container 6*b* for recovering the scraped toner.

The pre-exposing lamp 7, arranged adjacent to the upstream side of the primary charger 2, removes the unnecessary charge on the surface of the photosensitive drum 1 cleaned by the cleaner 6.

The paper feeder 8, having a plurality of paper feeding cassettes 8*a* which hold recording media P of different sizes, the recording media P paper feeding rollers 8*b* for feeding the recording media P in the paper feeding cassettes 8*a*, a plurality of carrying rollers, a registration roller 8*c* and so forth, feeds a recording medium P of a prescribed size to the transfer drum 5*a*.

The separating means 9 has a separating charger 9*a* for separating the recording medium P, to which a toner image has been transferred, from the transfer drum 5*a*, a separating claw 9*b* and a separating/upthrusting roller 9*c*.

The fixing device 10 has a fixing roller (fixing rotator) 10*a* having a heater inside and a press roller (press rotator) 10*b*, arranged underneath the fixing rotor, for pressing the recording medium P against the fixing roller 10*a*.

The paper output unit 11 has a deliverying path switching guide 11*a*, an output roller 11*b*, an output tray 11*c* and so on, all arranged downstream from the fixing device 10. Underneath the deliverying path switching guide 11*a* are arranged a vertical deliverying path lid for forming images on both sides of a single recording medium P, a reversing path 11*e*, a loading member 11*f*, an intermediate tray 11*g*, carrying rollers 11*h* and 11*i*, a reversing roller 11*j* and so forth.

Around the photosensitive drum 1, a potential sensor S1 for detecting the charged potential on the surface of the photosensitive drum 1 is arranged between the primary charger 2 and the developing unit 4, and a density sensor S2 for detecting the density of toner image on the photosensitive drum 1 is arranged between the developing unit 4 and the transfer drum 5*a*.

Next will be described the reader unit II. The reader unit II arranged above the printer unit I has a subject copy holding glass 12*a* on which to place a subject copy D, an exposing lamp 12*b* for exposing to light and scanning the image face of the subject copy D while moving, a plurality of mirrors 12*c* for further reflecting the reflected light from the subject copy D, a lens 12*d* for condensing the reflected lights, a full color sensor 12*e* for forming color-separated imaged signals on the basis of the light from the lens 12*d* and so forth. The color-separated imaged signals, going through an amplifier (not shown), are processed by a video processing unit (not shown) and delivered to the printer unit I.

Next will be briefly described the operation of the image forming apparatus having the above-stated constitution, supplemented with some constitutional explanations. In the following description, formation of a full four-color image in yellow, cyan, magenta and black in that order is supposed.

An image on the subject copy D placed on the subject copy holding glass 12*a* of the reader unit II is irradiated by the exposing lamp 12*b*, and color separation causes the full color sensor 12*e* to pick up the yellow image first, which undergoes prescribed processing to be delivered as an image signal to the printer unit I.

In the printer unit I, the photosensitive drum 1 is rotationally driven in the direction of arrow R1 and its surface is uniformly charged by the primary charger 2. On the basis of an image signal delivered from the reader unit II described above, a laser beam is emitted from the laser output section of the exposing means 3, and the surface of the photosensitive drum 1, already charged via the polygon mirror 3*a* and the like, is exposed to an optical image E. The exposed part of the surface of the photosensitive drum 1 is cleared of the electric charge, and an electrostatic latent image corresponding to the yellow component is formed. In the developing unit 4, the yellow developing device 4Y is arranged in the prescribed developing position, and the other developing devices 4C, 4M and 4Bk are kept away from the developing position. The electrostatic latent image on the photosensitive drum 1 is converted into a manifest toner image as the developing device 4Y sticks the yellow toner to the electrostatic latent image.

This yellow toner image on the photosensitive drum 1 is transferred to the recording medium P carried by the transfer drum 5*a*. The recording medium P has been fed at a prescribed timing to the transfer drum 5*a* from the paper feeding cassettes 8*a* prescribed for a recording medium P of the suitable size for the subject copy image via the paper feeding rollers 8*b*, carrying rollers, registration roller 8*c* and so forth. The recording medium P fed in this manner is attracted by and wound around the surface of the transfer drum 5*a* and rotates in the direction of arrow R5, and the transfer charger 5*b* transfers the yellow toner image on the photosensitive drum 1 to the recording medium P.

On the other hand, the photosensitive drum 1 after the transfer of the toner image is cleared of the residual toner on the surface by the cleaner 6 and of the unnecessary electric charge by the pre-exposing lamp 7, and thereby made ready for use in the formation of the next image beginning with the action of the primary charger.

The above-described process by the reader unit II from the pickup of the subject copy image to the transfer of the toner image to the recording medium P on the transfer drum 5*a*, cleaning of the photosensitive drum 1 and charge removal is similarly applied to other colors than yellow, i.e. cyan, magenta and black, so that four toner images, one superposed over another, are transferred to the recording medium P on the transfer drum 5*a*.

The recording medium P to which the toner images in the four colors have been transferred is separated from the transfer drum 5*a* by the separating charger 9*a*, the separating claw 9*b* and so forth, and deliveried to the fixing device 10 with an unfixed toner image remaining held on its surface. The recording medium P is heated and pressed by the fixing roller 10*a* and the press roller 10*b* of the fixing device 10, and the toner image on its surface is melted, solidified and eventually fixed. The recording medium P after the fixing of the toner image is discharged by the output roller 11*b* to the output tray 11*c*.

Where images are to be formed on both sides of the recording medium P, the carrying path switching guide 11*a* is immediately driven and, after once guiding the recording medium P from which the fixing device 10 has already been discharged to the reversing path 11*e* via the vertical carrying path 11*d*, the recording medium P is discharged, in the reversing direction to the direction in which it was first fed, by the reverse rotation of the reversing roller 11*j*, with the rear end in the first feeding entering first this time to be accommodated by the intermediate tray 11*g*. Then, after forming an image on the other side by going through the above-described image formation process again, this recording medium P is discharged into the output tray 11*c*.

In the transfer drum 5*a* after the separation of the recording medium P, in order to prevent scattered powder from sticking to the recording medium carrying sheet 5*g* and oil from adhering to the recording medium P, cleaning is accomplished with a fur brush 13*a* and a backup brush 13*b* on the one side and an oil removing roller 14*a* and a backup brush 14*b* on the other, opposite to each with the recording medium carrying sheet 5*g* in-between. This cleaning is done before or after image formation and as required if paper sheets run into a jam.

Next will be described the fixing device (denoted by 10 in FIG. 2) with reference to FIG. 3.

Figure 3:
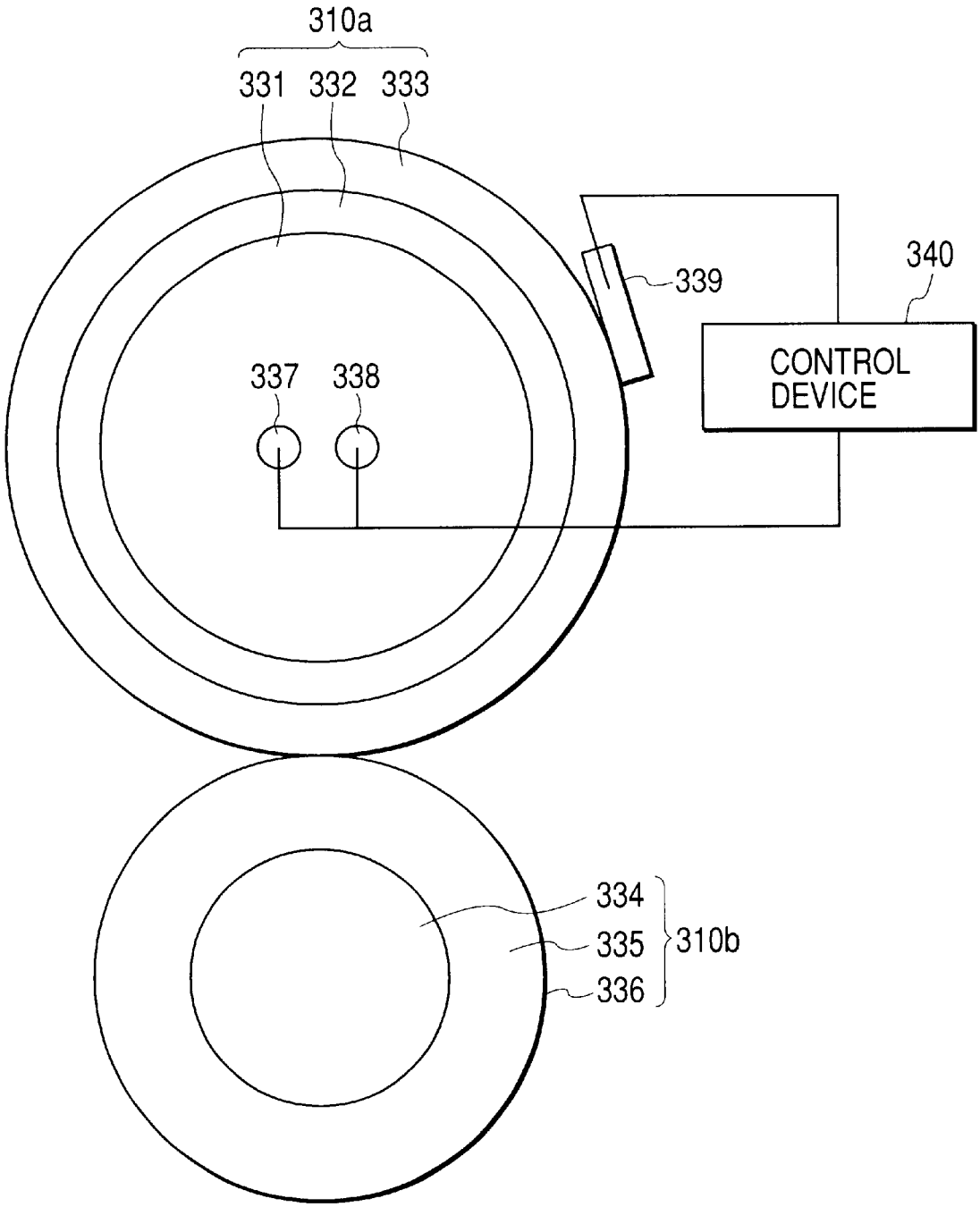
FIG. 3 shows a cross section of an example of a fixing device according to Embodiments 1 through 3 of the present invention.

Referring to FIG. 3, a fixing roller 310*a* in contact with the toner image has a 1.2 mm thick silicone rubber layer (elastic layer) 332 around a hollow iron core 331 of 0.7 mm in wall thickness and a 50 μm thick tetrafluoroethylene-perfluoroalkylvinyl ether (PFA) tube layer (release layer) 333 outside the silicone rubber layer, and is formed to have a diameter of 40 mm.

On the other hand, a press roller 310*b* has a 5 mm thick silicone rubber layer 335 around a solid iron core 334 and a 50 μm thick PFA tube layer 336 outside the silicone rubber layer, and is formed to have a diameter of 30 mm. Under a load of 1 kg, the Asker-C hardness of the fixing roller used in this embodiment is 75°, and that of the press roller is 65°. The Asker-C hardness of the press roller was measured with Asker-C rubber hardness tester under the same conditions as the fixing roller.

The fixing roller 310*a* has halogen heaters 337 and 338, which are heating means, arranged within the metal core 331. The fixing roller 310*a* has a thermistor (fixing roller temperature sensing means) 339 arranged in contact with the outer circumference of the roller. This thermistor 339 senses the temperature of the fixing roller 310*a*, and the halogen heaters 337 and 338 are controlled by a control device 340 on the basis of this sensed temperature to keep the temperature of the fixing roller 310*a* constant. The fixing roller 310*a* and the press roller 310*b* are placed under a total pressure of about 30 kg by a pressing mechanism (not shown). When fixing the recording medium P, the fixing roller 310*a* and the press roller 310*b* are rotating at a process speed of 100 mm/sec.

In the fixing device described above, the recording medium P carrying the unfixed toner image on its surface is nipped and deliveried by the fixing nip between the fixing roller 310*a* and the press roller 310*b*, and placed under pressure and heated in this while to have the toner fixed.

Next will be described the two component developer used in this embodiment.

The two component developer used in this embodiment contains separate toner particles for the four colors including yellow, cyan, magenta and black plus carrier particles. The toner particles used are products of usual methods.

The carrier particles used are particles of a spherical polymer carrier. Next will be described the production method for the spherical polymer carrier particles used in this embodiment.

50 parts by weight of phenol (hydroxybenzene), 80 parts by weight of 37% by weight formalin aqueous solution, 50 parts by weight of water, 280 parts by weight of magnetite fine particles having undergone surface treatment with a titanium coupling agent, 120 parts by weight of alumina fine particles having undergone surface treatment with a titanium coupling agent, and 15 parts by weight of 28% by weight ammonia water were put into a four-necked flask, heated to 85° C. in 40 minutes while stirring and mixing, kept at that temperature to be reacted for 180 minutes and hardened. The mixture was then cooled to 30° C. and, after adding 500 parts by weight of water, the supernatant liquor was removed, followed by washing and air-drying of the sediment. Then the deposit was dried under reduced pressure (5 mm Hg) at 60° C. for 24 hours. The shape factors SF-1 and SF-2 of the spherical polymer carrier obtained by the above-described technique were found to be 109 and 112, respectively. The producing method is not confined to the above-described, but it may as well be replaced by an emulsion polymerization method, or other materials can also be used as additives. As required, the surface of carrier particles may as well be covered with resin.

When durability in full color continuous paper feeding was tested with this embodiment using the above-described image forming apparatus and two component developer, no scrape was found on the fixing roller surface even after 100,000 sheets were passed.

As a comparative example, a similar durability test of full color continuous paper feeding was carried with conventional carrier particles (SF-1 =210 and SF-2 =195), a scrape was found on the fixing roller surface after about 60,000 sheets were passed.

Embodiment 2

This embodiment differed from Embodiment 1 in that the release layer of the fixing roller was altered to 20 μm thick polytetrafluoroethylene (PTFE). The Asker-C hardness of this fixing roller was 62°. In all other respects, Embodiment 2 was the same as Embodiment 1, and put to a durability test of full color continuous paper feeding, and no scrape was found on the fixing roller surface even after 100,000 sheets were passed.

As a comparative example with this embodiment again, a similar evaluation was conducted using conventional carrier particles with the result that a scrape was found on the fixing roller surface after about 70,000 sheets were passed.

Embodiment 3

This embodiment differed from Embodiment 1 in that the release layer of the fixing roller was altered to 15 μm thick tetrafluoroethylene-hexafluoropropylene copolymer (FEP copolymer). The Asker-C hardness of this fixing roller was 61°. In all other respects, Embodiment 3 was the same as Embodiment 1, and put to a durability test of full color continuous paper feeding, and no scrape was found on the fixing roller surface even after 100,000 sheets were passed.

As a comparative example with this embodiment again, a similar evaluation was conducted using conventional carrier particles with the result that a scrape was found on the fixing roller surface after about 50,000 sheets were passed.

Embodiment 4

Next will be described the fixing device (denoted by 10 in FIG. 2) used in Embodiment 4 with reference to FIG. 4.

Figure 4:
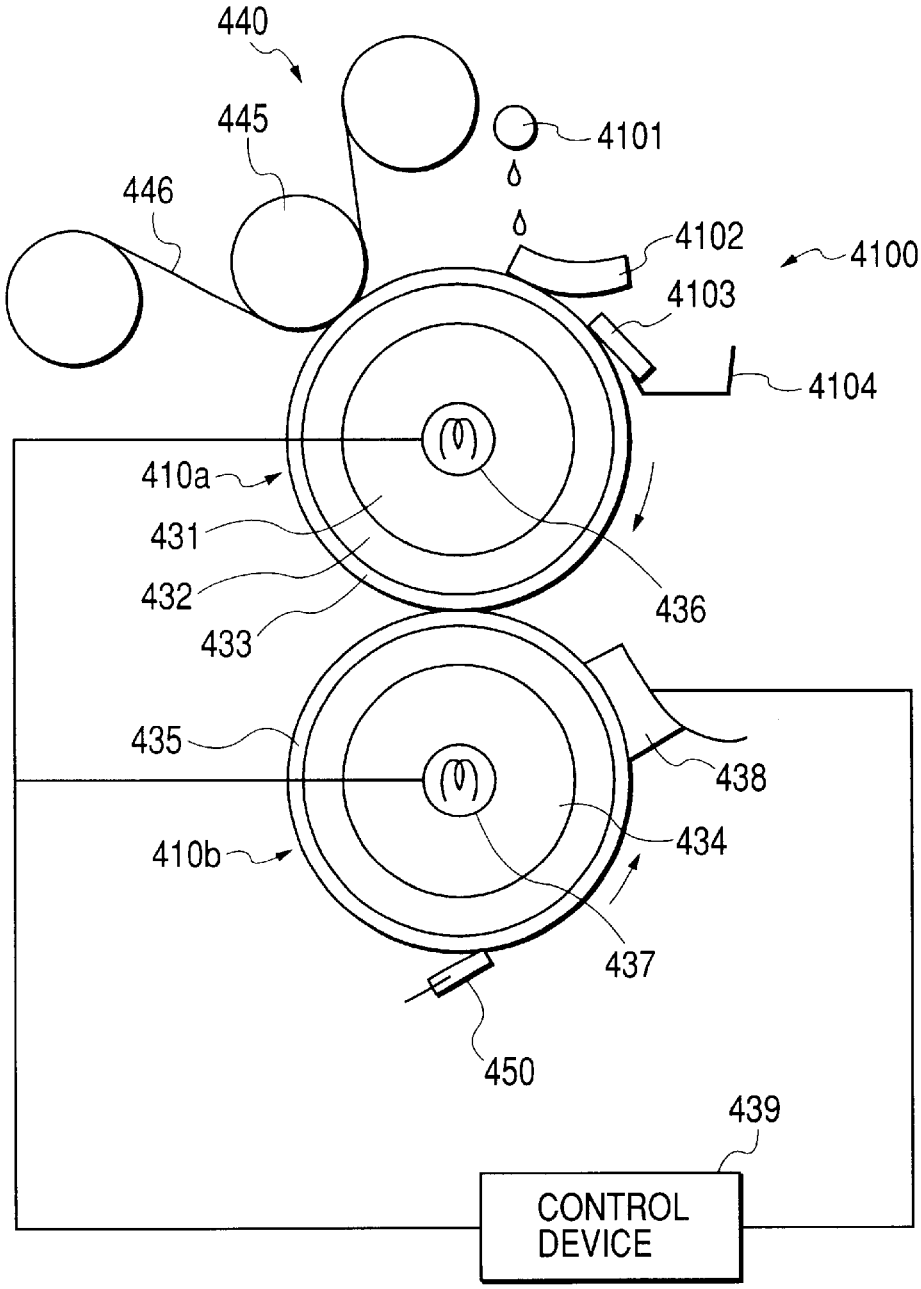
FIG. 4 shows a cross section of a fixing device according to Embodiment 4 of the invention.

Referring to FIG. 4, a fixing roller 410*a* in contact with the toner image has a 2 mm thick high temperature vulcanized (HTV) silicone rubber layer 432 around an aluminum core 431 and a specific additional type silicone rubber layer 433 outside the layer 432, and is formed to have a diameter of 60 mm.

On the other hand, a press roller 410*b* has a 2 mm thick HTV layer around an aluminum core 434 and a silicone rubber layer 435 of the specific additional type mentioned above, and is formed to have a diameter of 60 mm.

It is preferable for the additional type silicone rubber to be low temperature vulcanized (LTV) or room temperature vulcanized (RTV) silicone rubber, both of which well match the silicone oil of the release agent.

The fixing roller 410*a* has a heater 436, which is heating means, arranged within the metal core 431. The press roller 410*b* also has a heater 437 arranged within the metal core 434 to heat the recording medium P from both sides. A thermistor 438 arranged in contact with the press roller 410*b* senses the temperature of the press roller 410*b*, and the halogen heaters 436 and 437 are controlled by a control device 439 on the basis of this sensed temperature to keep the temperature of both the fixing roller 410*a* and the press roller 410*b* constant at 170° C. The fixing roller 410*a* and the press roller 410*b* are placed under a total pressure of about 50 kg by a pressing mechanism (not shown).

An oil applying device 4100, which is release agent applying means, a cleaner 440 and a cleaning blade 450 for clearing the press roller 410*b* of oil and smear are arranged.

The oil applying device 4100 supplies oil to an oil dropping pipe 4101 with an oil feed pump (not shown), evens off the silicone oil from there with an oil smoothing pad 4102 and a regulating blade 4103, which are release agent uniformizing members, and applies the silicone oil evenly over the fixing roller 410*a*. Superfluous oil is passed over the regulating blade 4103 and recovered into an oil pan 4104 for reuse.

The cleaner 440 cleans the surface of the fixing roller 410*a* with a web 446 brought into contact with the fixing roller 410*a* by a butt roller 445.

In the fixing device described above, the recording medium carrying the unfixed toner image on its surface is nipped and deliveried by a fixing nip between the fixing roller 410*a* and the press roller 410*b*, and placed under pressure and heated from both sides in this while to have the toner fixed. On this occasion, toner stuck to the fixing roller 410*a* and the press roller 410*b* is removed by the cleaner 440 and the cleaning blade 450.

This embodiment was configured similar to Embodiment 1 except for the fixing device. It was put to a durability test of full color continuous paper feeding, and any scrape was found on neither the fixing roller surface nor the press roller surface even after 100,000 sheets were passed. As a comparative example with this embodiment, a similar evaluation was conducted using a conventional pulverized carrier with the result that a scrape was found on the fixing roller after about 60,000 sheets were passed.

Although silicone rubber is used for the fixing roller and the press roller in this embodiment, rollers made of fluoro-rubber may as well be used. In this case, it is preferable to use as the release agent amino modified silicone oil, which well matches fluoro-rubber.

Embodiment 5

Figure 5:
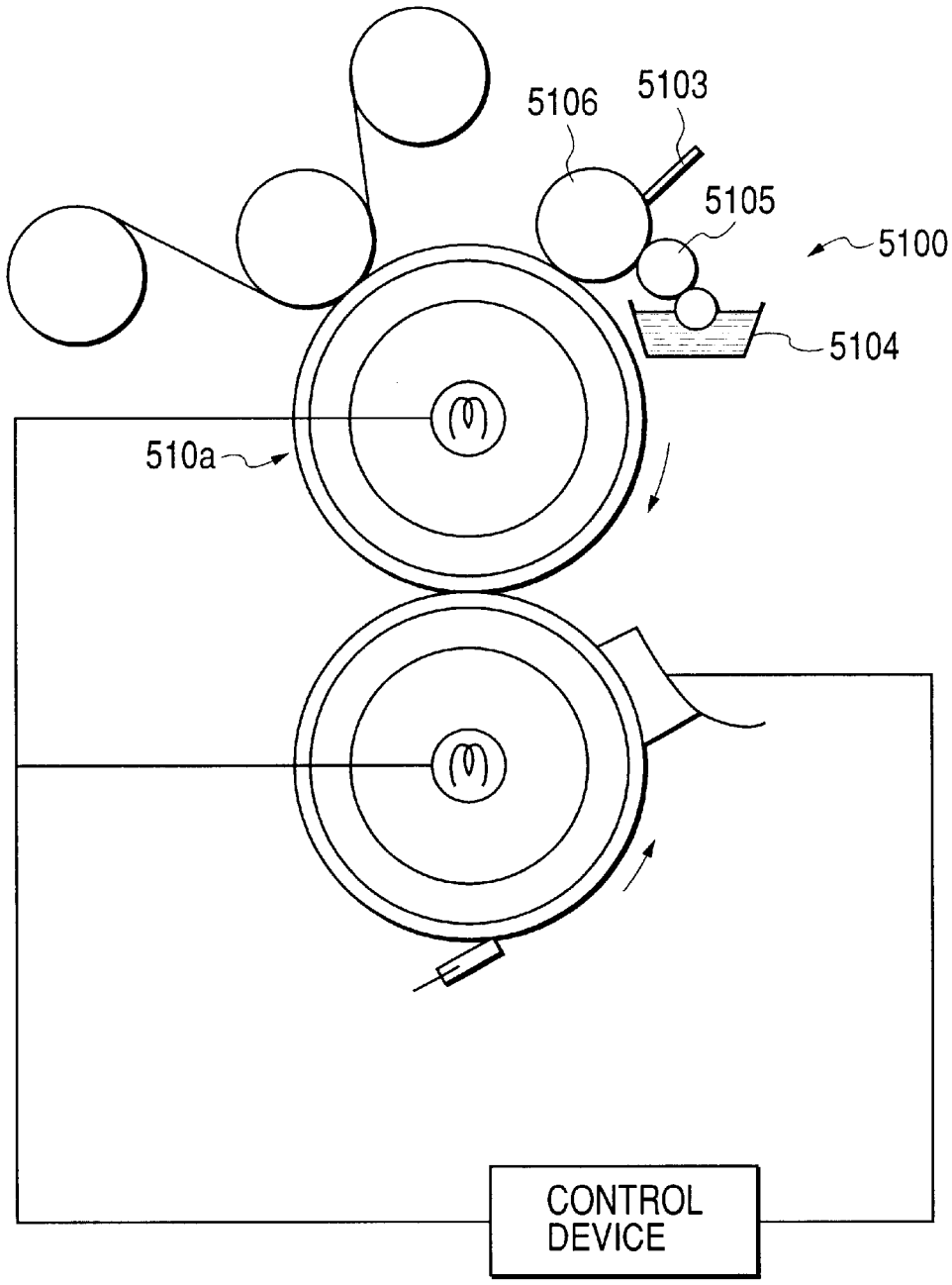
FIG. 5 shows a cross section of a fixing device according to Embodiment 5 of the invention.

Embodiment 5 of the present invention will be described below with reference to FIG. 5.

An oil applying mechanism 5100 causes silicone oil in an oil pan 5104 to be a lifting-up roller 5105 toward an oil applying roller 5106 and causes the oil applying roller 5106 to apply the silicone oil onto the surface of the fixing roller 510*a*. The quantity of silicone oil applied to the fixing roller 510*a* is regulated by a regulating blade 5103.

In all other respects, Embodiment 5 was made the same as Embodiment 4, and put to a durability test of full color continuous paper feeding, and any scrape was found on neither the fixing roller and the press roller even after 120,000 sheets were passed. As a comparative example with this Embodiment 5 again, a similar evaluation was conducted using a conventional pulverized carrier with the result that a scrape was found on the fixing roller surface after about 70,000 sheets were passed.

What is claimed is:

1. An image forming apparatus comprising:

image forming means for forming an electrostatic latent image corresponding to an image information signal on an image carrying member, forming an unfixed image by developing said electrostatic latent image using a two component developer consisting of toner particles and carrier particles and transferring the unfixed image to a transfer medium; and fixing means, provided with at least a fixing roller and a press roller, for nipping and delivering the transfer medium with said rollers to fix the unfixed image, wherein said carrier particles contain at least binder resin and magnetic metal oxide and have shape factors SF-1 of 100 to 150 and SF-2 of 100 to 150, wherein the carrier particles having the shape factors SF-1 and SF-2 (i) inhibit friction between the toner particles and the carrier particles and (ii) inhibit occurrence of fine powder caused by friction between the toner and the carrier particles and between the carrier particles, and said fixing roller has an elastic layer and a release layer consisting of fluorine resin, with its Asker-C hardness ranging between 60° and 85° at the time of application of a load of 1 kg.

2. The image forming apparatus according to claim 1, wherein said carrier particles are produced by polymerization.

3. The image forming apparatus according to claim 1, wherein said fixing means is in contact with said fixing roller and has fixing roller temperature sensing means for sensing the temperature of the fixing roller.

4. An image forming apparatus comprising:

image forming means for forming an electrostatic latent image corresponding to an image information signal on an image carrying member, forming an unfixed image by developing the electrostatic latent image using a two component developer consisting of toner particles and carrier particles and transferring the unfixed image to a transfer medium; and fixing means for nipping and delivering the transfer medium with a fixing roller and a press roller to fix the unfixed image, wherein the carrier particles are a magnetic resin carrier containing binder resin, magnetic metal oxide and non-magnetic metal oxide produced by polymerization and shape factors SF-1 of 100 to 150 and SF-2 of 100 to 150, and said fixing roller contains silicone rubber or fluoro-rubber, wherein the carrier particles having the shape factors SF-1 and SF-2 (i) inhibit friction between the toner particles and the carrier particles and (ii) inhibit occurrence of fine powder caused by friction between the toner and the carrier particles and between the carrier particles.

5. The image forming apparatus according to claim 4, wherein said fixing means is provided with:

means for supplying a release agent to the surface of said fixing roller;

release agent uniformizing means for uniformizing the release agent; and release agent quantity regulating means for regulating the quantity of the release agent.

* * * * *